US008375585B1

(12) United States Patent
Sittler

(10) Patent No.: US 8,375,585 B1
(45) Date of Patent: Feb. 19, 2013

(54) SELF-CONTAINED BRACELET ATTACHING DEVICE AND BRACELET CONTAINING SAME AND METHOD FOR ATTACHING SAID BRACELET

(76) Inventor: Katharine Charity Sittler, Metairie, LA (US)

( * ) Notice: Subject to any disclaimer, the term of this patent is extended or adjusted under 35 U.S.C. 154(b) by 537 days.

(21) Appl. No.: 12/586,677

(22) Filed: Sep. 25, 2009

Related U.S. Application Data

(60) Provisional application No. 61/194,756, filed on Sep. 30, 2008.

(51) Int. Cl.
*A44C 27/00* (2006.01)

(52) U.S. Cl. ..... 29/896.11; 29/896.42; 29/525.01; 63/4

(58) Field of Classification Search ..... 29/525.01, 29/896.4, 896.41, 896.411, 896.42; 24/1, 24/3.1, 3.11, 3.12, 3.13, 3.2; 223/111; 63/4
See application file for complete search history.

(56) References Cited

U.S. PATENT DOCUMENTS

| | | | | |
|---|---|---|---|---|
| 1,479,130 | A * | 1/1924 | Foster | 24/68 J |
| 5,709,327 | A * | 1/1998 | LaMacchia et al. | 223/111 |
| 5,741,035 | A * | 4/1998 | Glass | 294/25 |
| 5,785,217 | A * | 7/1998 | Gorham, Jr. | 223/111 |
| 5,934,526 | A * | 8/1999 | Rosenbaum et al. | 223/111 |
| 6,032,996 | A * | 3/2000 | Kogen | 294/2 |
| 6,036,065 | A * | 3/2000 | Wofford et al. | 223/111 |
| 6,112,958 | A * | 9/2000 | LaMacchia et al. | 223/111 |
| 7,712,643 | B2 * | 5/2010 | Papernik | 223/111 |
| 2007/0074375 | A1 * | 4/2007 | Papernik | 24/1 |

* cited by examiner

*Primary Examiner* — David Bryant
*Assistant Examiner* — Ryan J Walters
(74) *Attorney, Agent, or Firm* — Douglas E. Sittler

(57) ABSTRACT

Disclosed is a combination of a bracelet and a device for assisting in attaching a bracelet of the type having a clasp at one end and a receiver at the other end and being flexible between such ends. The device comprises a dangling member attached to the bracelet, which dangling member is of sufficient length so that at least one finger of the wearer's involved hand can engage the dangling member against the involved hand and thereby position said receiver at or near the wrist while the wearer's other hand manipulates the clasp at the other end of the bracelet so as to bring such clasp into proximity with the receiver and then so as to attach the bracelet. In another embodiment of the invention, a detachably attachable dangling member is disclosed that can be retrofitted to a typical bracelet. In another embodiment of the invention, the dangling member is permanently attached near one end of the bracelet and is detachably attachable elsewhere on the bracelet. A method is disclosed in which a wearer of a bracelet can attach the ends of a bracelet without assistance by any other person by squeezing a dangling member attached to said bracelet against the involved hand with at least one finger of the involved hand, thereby positioning the receiver at one end of the bracelet at or near the wearer's involved wrist and allowing the wearer's other hand to complete the attachment of the bracelet.

10 Claims, 2 Drawing Sheets

SELF-CONTAINED BRACELET ATTACHING DEVICE AND BRACELET CONTAINING SAME AND METHOD FOR ATTACHING SAID BRACELET

CROSS-REFERENCE TO RELATED APPLICATION

This application claims priority date of provisional application USPTO Ser. No. 61/194,756, filed Sep. 30, 2008, entitled "Self-Contained Bracelet Attaching Device and Bracelet Containing Same," and first named inventor, Katharine Charity Sittler.

FIELD OF THE INVENTION

The instant invention relates to devices intended to assist in attaching a bracelet of the type having a clasp at one end and a receiver at the other end and being flexible between such ends and, in particular, to such devices which are self-contained in and an integral part of such a bracelet or which can be retrofitted to become so self-contained and such an integral part and, thus, to bracelets which contain such devices.

BACKGROUND OF THE INVENTION

It has long been a problem to quickly and easily attach a bracelet or similar device (hereafter collectively, "bracelet") around the wearer's wrist when such bracelet attaches with a clasp or clip or other attaching means (hereafter collectively, "clasp"). Many inventions exist to assist in such effort.

Examples of devices for assisting in the attachment of such bracelets are described in U.S. Pat. Nos. 2,896,890 (Hlavac); 3,242,540 (Mitchell); 4,650,141 (Longo et al.); 5,405,066 (Fakier); 5,741,035 (Glass); 5,785,217 (Gorham, Jr.); 5,934,526 (Rosenbaum et al.); 6,036,065 (Wofford et al.); 6,095,346 (Idelberger); 6,293,444 (Miller); and 6,854,625 (Tedeschi).

Hlavac '890 assumed and taught that "Since during this operation the hand of the wrist involved is not available for use, the attaching of the bracelet is of necessity a one-handed proposition." However, Mitchell '540, Glass '035, Gorham, Jr. '217, Wofford '065 and Miller '444 all teach of devices in which the hand of the wrist involved with wearing the bracelet holds the device that assists in the effort to attach the bracelet. It is problematic that any of these devices could be misplaced or otherwise not available when the wearer wishes to put on his or her bracelet. Idelberger '346 attempts to solve this problem by combining a display rack for bracelets with a device for assisting in the attachment of a bracelet. However, all of these devices are separate from the bracelet, itself. Even the device on the Idelberger '346 display rack generally would not be available if the wearer of the bracelet were away from home or other customary place where the display rack was kept.

There is a need in this art for a simple device, self-contained within and an integral part of the bracelet, itself, to assist in the effort of attaching the bracelet. If the device is to be an integral part of an ornamental bracelet, the device may be similarly ornamental.

SUMMARY OF THE INVENTION

The instant invention provides a device which can be held by the hand of the wrist involved with wearing the bracelet and which device can assist in the attaching of the bracelet and which device is or can be made to be self-contained within and an integral part of the bracelet, itself. Thus, the invention is also a bracelet containing such device.

The inventive device is or can be made to be generally a simple, dangling member of the bracelet, itself, of a sufficient length so that one or more fingers of the involved hand can squeeze the dangling member against the base of the thumb of the involved hand and thereby hold one end of the bracelet while the other hand manipulates the other end of the bracelet and the clasp at such other end.

A novel feature of the inventive device is that, when the dangling member is situated at or near either clasp end of a bracelet, the extra weight thereof tends to keep the clasp of the bracelet below the wrist and, thus, the more ornamental portion of the bracelet above the wrist.

In another embodiment of the invention, the dangling end of the dangling member can be detachably attached to the bracelet so as not to dangle while the bracelet is being worn.

In another embodiment of the invention, a method is disclosed for attaching a bracelet with such a dangling member.

DETAILED DESCRIPTION

Figure 1:
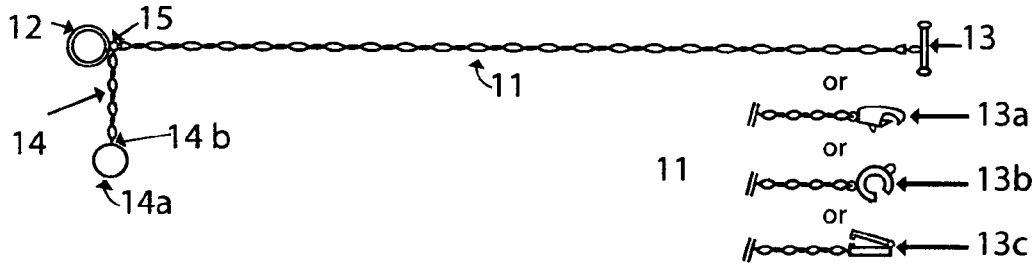
FIG. 1 illustrates a bracelet with an example of a dangling member aspect of the invention attached near the receiving end of the bracelet and with various alternative clasp ends.

Referring now to FIG. 1, FIG. 1 illustrates a typical bracelet 11 with a typical receiving end 12, generally in the form of a ring, and a typical clasp end 13. While not exhaustive examples, other typical clasp ends are shown as typical clasp end 13*a*, typical clasp end 13*b* and typical clasp end 13*c*. Dangling member 14 is permanently attached to bracelet 11 at jump ring 15 which is a circular link in bracelet 11. Dangling member 14 is shown with optional end member 14*a* at the end 14*b* of dangling member 14.

Figure 2:
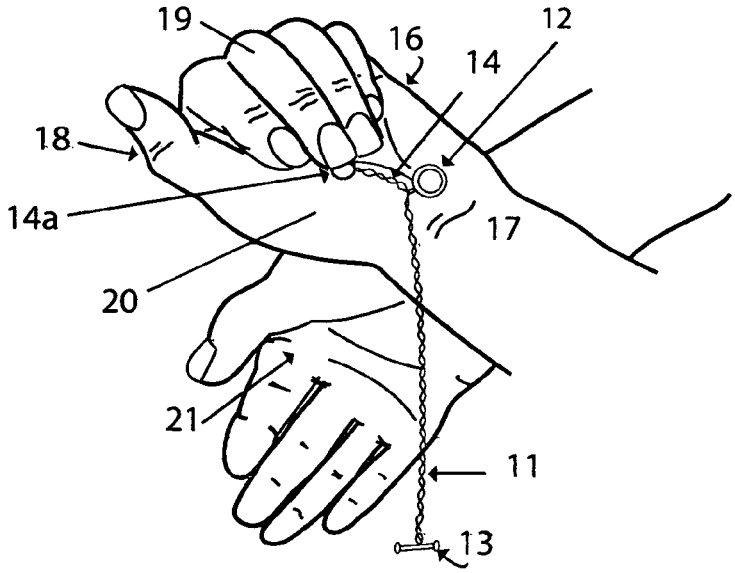
FIG. 2 illustrates the middle finger of the hand involved with wearing the bracelet holding the dangling member and the rest of the bracelet dangling over the base of the thumb alongside the wearing wrist making the clasp end of the bracelet available to the other hand.

Referring now to FIG. 2, FIG. 2 illustrates one hand 16 involved with the wrist 17 around which the bracelet 11 is to be worn. Middle finger 19 of hand 16 is shown pressing end member 14*a* at the end of dangling member 14 against the base of the thumb 20 of thumb 18 of hand 16. (However, any finger of hand 16 or combination of adjacent fingers of hand 16 may be used in such pressing.) While hand 16 is held upward, the force of gravity causes dangling member 14 to fall along the base of the thumb toward wrist 17 and the receiving end 12 to dangle at or about wrist 17 and the rest of bracelet 11 to dangle down the below the base of the thumb 20 alongside the wrist 17 upon which the bracelet is to be worn, on the thumb side of such wrist 17, making the clasp end 13 available to the other hand 21 of the wearer.

Figure 3:
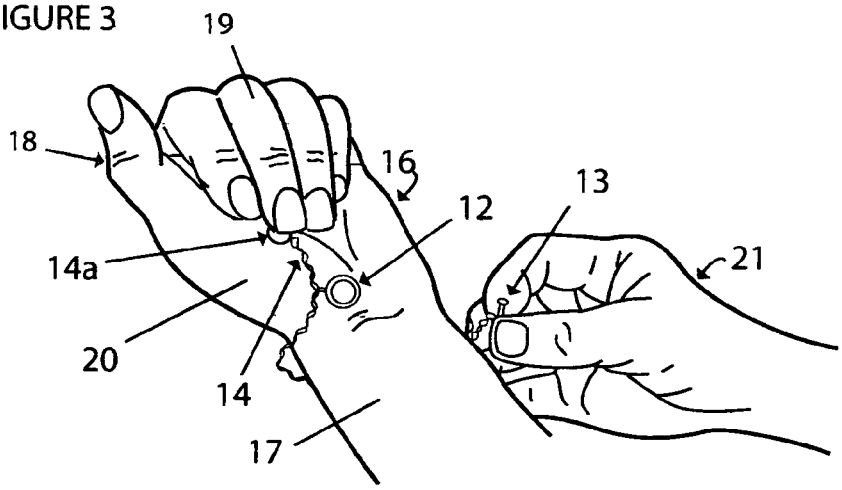
FIG. 3 illustrates the middle finger of the hand involved with wearing the bracelet holding the dangling member so as to place the receiving end of the bracelet at or about the wearing wrist and the other hand holding the clasp end of the bracelet after having come around the top of the wearing wrist.

Referring now to FIG. 3, FIG. 3 illustrates the other hand 21 grasping the clasp end 13 after having taken it around the top of the hand 16 (opposite the palm of hand 16) from its dangling position as illustrated in FIG. 2 and preparing to put the clasp end 13 near the receiving end 12.

Figure 4:
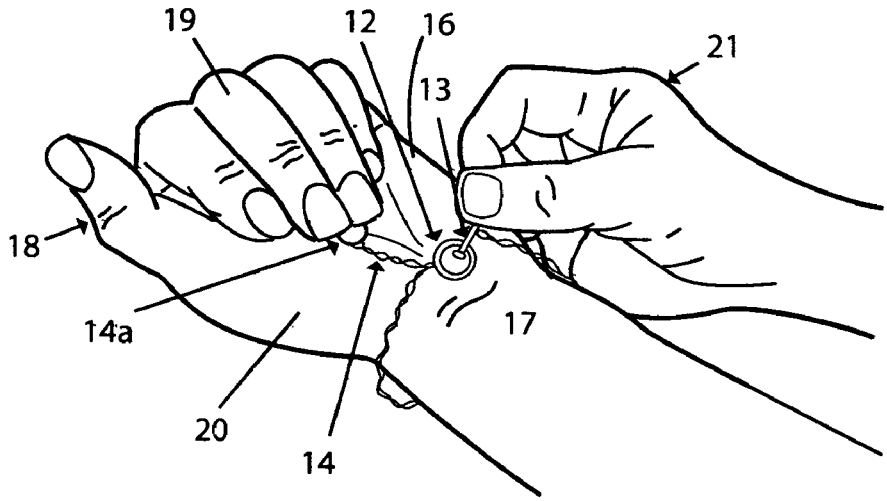
FIG. 4 illustrates the middle finger of the hand involved with wearing the bracelet holding the dangling member so as to place the receiving end of the bracelet at or about the wearing wrist and the other hand holding the clasp end of the bracelet and manipulating the clasp end of the bracelet to attach the clasp end of the bracelet to the receiving end of the bracelet.

Referring now to FIG. 4, FIG. 4 illustrates the other hand 21 grasping the clasp end 13 after bringing it into proximity with the receiving end 12 from its position illustrated in FIG. 3 and manipulating the clasp end 13 to attach it to receiving end 12 and, thus, to attach the bracelet, as desired. Preferably, receiving end 12 will rest against wrist 17 so that wrist 17 can assist in such attachment by preventing receiving end 12 from moving during such attachment.

After such attachment of bracelet 11, upon releasing the dangling member 14 and end member 14*a*, the bracelet 11 falls into the desired wearing position.

Depending on the length and dexterity of the fingers and other geometry of the hand 16 involved with the wrist 17 upon which the bracelet 11 is to be worn, the optimal length of the dangling member 14—or, if used with end member 14*a*, their optimal combined length—will be between about the length of the thumbnail of hand 16 and about the length from the end of the thumb 18 to the knuckle of the thumb 18 of hand 16 or approximately between one-half inch and one and one-half inches for the average person. A significantly longer length, while still within the instant invention, would not only tend to lose ornamental value, depending on individual taste and fashion, but could be long enough to possibly interfere with the attachment of the bracelet 11.

Dangling member 14 is preferably flexible so that it will conform to the shape of the base of the thumb 20 when dangling member 14 or end member 14*a* is being pressed against the base of the thumb 20. If dangling member 14 were not flexible, then the pressing of it or of end member 14*a* into the base of the thumb 20 would tend to cause the receiving end 12 to protrude into the air away from wrist 17 making attachment more difficult and requiring the bracelet 11 to be longer than necessary. Furthermore, wearing a rigid dangling member 14 could interfere with handwriting by the involved hand and could be dangerous (like wearing a nail on a bracelet). Finally, a flexible dangling member 14 could be made to look like the rest of bracelet 11. For example, if bracelet 11 were a flexible chain of diamonds, beads or precious stones, then a flexible dangling member 14 could be likewise comprised of a flexible chain of diamonds, beads or precious stones.

When an end member 14*a* is used, the dangling member 14 is preferably between about as long as the end member 14*a* and about twice as long as end member 14*a*. (still with their combined lengths being no more than about one and one-half inches). Furthermore, end member 14*a* is preferably flat and rigid to provide an optimal surface against which one or more fingers of hand 16 can squeeze it into the base of the thumb 20.

Optimal placement of dangling member 14 is at or near receiving end 12 of bracelet 11. With such placement, receiving end 12 is optimally positioned at wrist 17 so that clasp end 13, which usually requires more manipulation, can be manipulated optimally against wrist 17 by the other hand 21 as discussed above. Additionally, after the bracelet is attached and worn, the extra weight of dangling member 14, so placed, in combination with the force of gravity and the natural jiggling motion involved with wearing the bracelet 11, tends to keep the attached ends of bracelet 11 below the wrist 17 which, in turn, keeps the more ornamental portion of the bracelet 11 on the top side of the wrist 17 so that said ornamental portion of bracelet 11 can be seen by another person looking down upon the wrist 17 of the wearer of the bracelet 11, as desired by the typical wearer of ornamental bracelets.

The farther away the dangling member 14 is placed from the receiving end 12 of the bracelet 11, (a) the less taut the receiving end is held at the wrist 17 below the base of the thumb 20 and, thus, the harder it is to manipulate the clasp end 13 to attach to the receiving end 12 and (b) the less likely it becomes that the ornamental portion of the bracelet will display on the top side of the wrist. In the most extreme case of attaching the dangling member opposite the attached ends of bracelet 11 in the middle of bracelet 11 and the ornamental portion of bracelet 11, said ornamental portion would actually tend to display below the wrist where it would be least visible from above.

Figure 5:
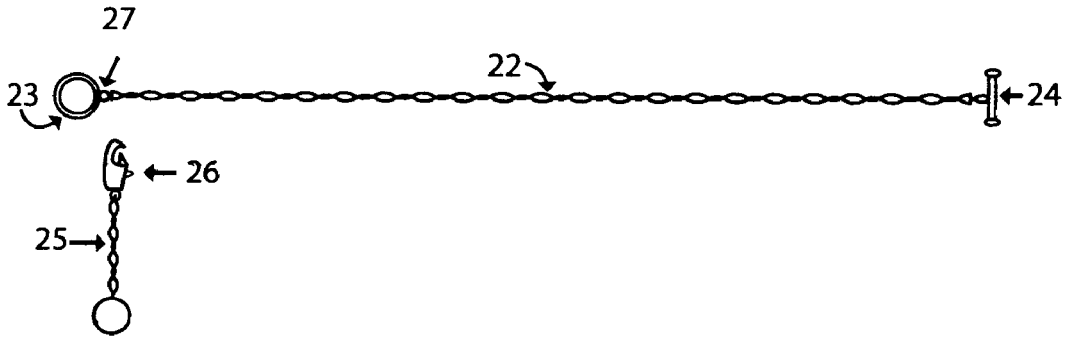
FIG. 5 illustrates a detachably attachable dangling member near the receiving end of a bracelet.

Referring now to FIG. 5, FIG. 5 illustrates a typical ornamental bracelet 22 with a typical receiving end 23 and a typical clasp end 24. FIG. 3 further illustrates a detachably attachable dangling member 25 with a clasp end 26 with which dangling member 25 can be detachably attached to any typical bracelet 22 either at a jump ring 27 anywhere along the length of bracelet 22, but preferably near receiving end 23, or at receiving end 23, itself. Thus, any typical bracelet could be retrofitted with such a detachably attachable dangling member.

Figure 6:
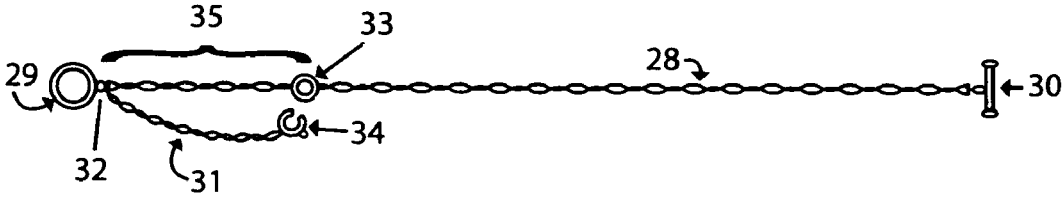
FIG. 6 illustrates a bracelet with a dangling member permanently attached near the receiving end of a bracelet and detachably attachable at a point elsewhere on the bracelet.

Referring now to FIG. 6, FIG. 6 illustrates another embodiment of the invention in which an ornamental bracelet 28 has a typical receiving end 29 and a typical clasp end 30 and a dangling member 31 which is permanently attached to bracelet 28 at a first jump ring 32 and is detachably attachable to bracelet 28 at a second jump ring 33 by means of a clasp end 34 of the dangling member 31. The optimal length of the distance 35 between the first jump ring 32 and second jump ring 33 is approximately the same as the length of dangling member 31 so as to minimize any slack in the detachably attached dangling member 31 (if the distance 35 is shorter than dangling member 31) and in the rest of the bracelet 28 (if the distance 35 is longer than dangling member 31). In this embodiment, the dangling member 31 can be used to assist in such attachment and then can be attached at jump ring 33 so as not to dangle during the wearing of the bracelet 28.

The following is claimed:

1. A method for attaching a bracelet, said bracelet having a clasp end with a clasp and a receiving end attachable with said clasp end, and said bracelet also having a dangling member attached at or near said receiving end of said bracelet, said dangling member having a first end and a second end, said first end having an attachable connection with said bracelet and said second end being unattached to said bracelet, said dangling member being self-contained within and an integral part of said bracelet, said method comprising:

pressing said unattached end of said dangling member by at least one finger of a hand involved with a wrist around which said bracelet is to be worn against a base of a thumb of said involved hand;

elevating said involved hand so that the receiving end of said bracelet falls to at or about the involved wrist and said clasp end of said bracelet dangles along one side of said involved wrist;

taking said clasp end around the hack of said involved hand;

positioning said clasp end at or near said receiving end as it lies at or about said involved wrist;

manipulating said clasp end by the wearer's other hand to attach said clasp end to said receiving end;

releasing said dangling member by the wearer's at least one finger ceasing to so press said unattached end and wearing said bracelet with said dangling member remaining attached to said bracelet.

2. The method of claim 1 wherein said taking of said clasp end around said back of said involved hand is accomplished by said wearer's said other hand grasping said clasp end of said bracelet and so taking said clasp end around said back of said involved hand.

3. The method of claim 2 wherein said positioning of said clasp end at or near said receiving end is accomplished by said wearer's said other hand so positioning said clasp end.

4. A method for attaching a bracelet, said bracelet having a clasp end with a clasp and a receiving end attachable with said clasp end, and said bracelet also having a dangling member attached at or near said receiving end of said bracelet, said dangling member having a first end and a second end, said first end having an attachable connection with said bracelet and said second end being unattached to said bracelet, said method comprising:

pressing said unattached end of said dangling member by at least one finger of a hand involved with a wrist around which said bracelet is to be worn against a base of a thumb of said involved hand;

taking said clasp end around the back of said involved hand;

positioning said clasp end at or near said receiving end as it lies at or about said involved wrist;

manipulating said clasp end by the wearer's other hand to attach said clasp end to said receiving end;

releasing said dangling member by the wearer's at least one finger ceasing to so press said unattached end and wearing said bracelet with said dangling member remaining attached to said bracelet.

5. The method of claim 4 wherein said taking of said clasp end around said back of said involved hand is accomplished by said wearer's said other hand grasping said clasp end of said bracelet and so taking said clasp end around said back of said involved hand.

6. The method of claim 4 wherein said positioning of said clasp end at or near said receiving end is accomplished by said wearer's said other hand so positioning said clasp end.

7. A method for attaching a bracelet, said bracelet having a clasp end with a clasp and a receiving end attachable with said clasp end, and said bracelet also having a dangling member attached at or near said receiving end of said bracelet, said dangling member having a first end and a second end, said first end having an attachable connection with said bracelet and said second end being unattached to said bracelet, said dangling member being an integral part of said bracelet, said method comprising:

pressing said unattached end of said dangling member by at least one finger of a hand involved with a wrist around which said bracelet is to be worn against a base of a thumb of said involved hand;

taking said clasp end around the back of said involved hand;

positioning said clasp end at or near said receiving end as it lies at or about said involved wrist;

manipulating said clasp end by the wearer's other hand to attach said clasp end to said receiving end;

releasing said dangling member by the wearer's at least one finger ceasing to so press said unattached end and wearing said bracelet with said dangling member remaining attached to said bracelet.

8. The method of claim 7 wherein said taking of said clasp end around said back of said involved hand is accomplished by said wearer's said other hand grasping said clasp end of said bracelet and so taking said clasp end around said back of said involved hand.

9. The method of claim 7 wherein said positioning of said clasp end at or near said receiving end is accomplished by said wearer's said other hand so positioning said clasp end.

10. The method of claim 7 further comprising, after pressing said unattached end of said dangling member by at least one finger of a hand involved with a wrist around which said bracelet is to be worn against a base of a thumb of said involved hand, elevating said involved hand so that the receiving end of said bracelet falls to at or about the involved wrist and said clasp end of said bracelet dangles along one side of said involved wrist.

* * * * *